US007959028B2

(12) United States Patent
Leon

(10) Patent No.: US 7,959,028 B2
(45) Date of Patent: Jun. 14, 2011

(54) LID FOR BEVERAGE CONTAINERS

(76) Inventor: Richard J. Leon, San Diego, CA (US)

( * ) Notice: Subject to any disclaimer, the term of this patent is extended or adjusted under 35 U.S.C. 154(b) by 286 days.

(21) Appl. No.: 11/820,275

(22) Filed: Jun. 19, 2007

(65) Prior Publication Data

US 2008/0000921 A1 Jan. 3, 2008

Related U.S. Application Data

(60) Provisional application No. 60/818,436, filed on Jul. 3, 2006.

(51) Int. Cl.
*B65D 51/16* (2006.01)
*B65D 51/12* (2006.01)
*B65D 25/54* (2006.01)

(52) U.S. Cl. ..... 220/717; 220/213; 220/367.1; 220/602; 220/713; 220/714

(58) Field of Classification Search ..... 220/203.18, 220/213, 254.1, 254.3, 367.1, 602, 713, 714, 220/717
See application file for complete search history.

(56) References Cited

U.S. PATENT DOCUMENTS 5,894,952 A * 4/1999 Mendenhall et al. ..... 220/713
6,578,726 B1 * 6/2003 Schaefer ..... 220/253
6,889,859 B1 * 5/2005 Leon ..... 220/254.3
7,134,570 B1 * 11/2006 Heath et al. ..... 220/717
7,175,042 B2 * 2/2007 Durdon ..... 220/254.3
2005/0109780 A1 * 5/2005 Pendergrass et al. ..... 220/254.1
2007/0045316 A1 * 3/2007 Arnljots ..... 220/254.5

* cited by examiner

*Primary Examiner* — Anthony Stashick
*Assistant Examiner* — Madison L Wright
(74) *Attorney, Agent, or Firm* — Dauman, Dow & León, P.C.; Alberto A. León, Esq.

(57) ABSTRACT

An improved lid for beverage containers which facilitates access to the container's contents, enhances the user's sensory perception of the contents and boosts the overall drinking experience without being removed, is disclosed and claimed. The lid of the invention achieves its objectives by combining multiple sensory elements to simultaneously enhance the user's sensory responses. The sensory elements allow the passage of liquid and vapor, the conduction and convection of heat and the visual perception of color, level and movement of the beverage. The invention integrates multiple elements of a press and lock on a beverage container lid. The shape of the lid provides a thin rim simulating the thickness of a lidless cup or a non-disposable mug or cup. The lid provides a well deep enough to avoid contact between the nose and the lid in the drinking position, thereby allowing the user's head to remain more upright while drinking.

6 Claims, 3 Drawing Sheets

LID FOR BEVERAGE CONTAINERS

CROSS-REFERENCE TO RELATED APPLICATION

I hereby claim the benefit under Title 35, United States Code Section 119(e) of any United States Provisional Application(s) listed below:
Application No. 60/818,436
Filing Date Jul. 3, 2006

BACKGROUND OF THE INVENTION

1. Technical Field of the Invention

Lids, beverage containers, lids for beverage containers, hot beverage container lid, temperature sensing devices, smell, sight and taste enhancing media, beverage container lid with beverage access means.

2. Description of the Invention

Disposable beverage cups and lids have been in use since the early $20^{th}$ century. Those devices were invented out of health concerns which arose from contagious conditions being transmitted from using the then common shared glasses or dippers at water sources such as school faucets or water barrels in trains. The first widely used disposable cup was the Dixie Cup which was made of paper and invented in 1908. Over the years, many other disposable cups of varying sizes and materials have been introduced into the market. The weight and thickness of the material varied with the type and temperature of the beverage for which the various cups were being used. More recently, starting with the rapidly gained popularity and high volume output of the fast-food industry, the need for hot-beverage cups with lids became evident. The inception of drive-up window service usually associated with the fast-food industry made the safe containment of hot beverages an important requirement. In addition, the safe manipulation of the container for drinking without inhibiting vision while simultaneously driving and drinking a hot beverage became an increasingly pressing requirement.

A more recent phenomenon, causing a different demand for lids and cups, is the worldwide proliferation of gourmet coffee-based establishments which serve exotic varieties of rich, hot coffee and high quality hot teas, at costs up to $18.00 per gallon—nearly six times the cost of premium gasoline. The demand for hot coffee and teas served by those gourmet coffee establishments has been extremely healthy and continues to grow. However, there has not been much, if any, significant improvement in the container, i.e., the lid and cup, from the standpoint of the consumer's: (1) ability to manipulate and handle the container; (2) face to ergonomically interact with the lid; and (3) enhancement of sensory perception connected with the coffee consumption.

Most gourmet hot coffee cups are made of sufficiently resistant paper, paper-polymeric composites, or rigid Styrofoam materials. The cup maintains its shape and structural integrity more effectively with a lid firmly placed and held on the top of the cup. The server usually places the lid on the cup after the coffee is poured into the cup. The lid and cup combination results in a stronger container than the individual strengths of the separate components. The newest paper cups, with a plastic lid press-fitted in place create an adequately strong container. In some cases, the cup wall without the lid tends to deform under the grasp of a human hand.

There are generally two gourmet or premium coffee-by-the-cup consumer types: the walk-in consumer, and the drive-up consumer. The walk-in consumer walks into an establishment, receives a cup of coffee, in a cup with a lid affixed over the counter. Then, if this type of consumer does not drink just black unsweetened coffee, the consumer takes the hot cup of coffee to a condiment counter where the lid is removed to facilitate the addition of dairy products and/or condiments. The lid is usually set on the condiment counter while the consumer uses both hands to add condiments and stir them into the coffee. This consumer type then generally replaces the lid and drinks the coffee either at a table, or while walking to a destination. Many consumers, whether drinkers of creamed and sweetened or black coffee, throw the lid away in order to enjoy the aroma, taste, color, motion and temperature of the coffee, and to eliminate the cumbersome nature of the lid-cup combination.

The type of consumer who walks out of the coffee establishment and drinks his/her coffee while walking among other pedestrians, urban obstacles and vehicular traffic, dangerously impedes his/her forward vision when the cup is approaching approximately one third empty. Beyond this approach, this type of consumer critically loses binocular vision, including some forward sight while the lid surface interferes with his/her nose due to the need to acutely tilt his head backward to allow dispensing of the coffee. The conventional prior art lid in this consumption mode causes a significant safety hazard to this type of consumer when he/she is walking and drinking coffee in heavy pedestrian traffic or in and around urban vehicular traffic. A sight impeded person in such an environment could: trip up, compromise the integrity of the container and cause scalding coffee to pour on himself or another person; fall and become injured; collide with objects and persons; be stricken by a car while crossing the street; or otherwise place their self in harm's way. This conventional lid hazard becomes greater to the drive-up consumer and to others in the path of his/her vehicle while the consumer drinks through a conventional lid on a cup of coffee served at a drive-up window.

The lids of the prior art generally have a small racetrack oval shaped drinking hole near the perimeter of the lid allowing the consumer to drink and taste the coffee. One brand of prior art lid has a larger rectangular, almost square, shaped whole near the lid perimeter. The drinking holes of all lids of the prior art are on a horizontal plane. The size and orientation of the racetrack oval shaped drinking hole lids cause their rim thicknesses, relative to the rim diameter, to be wider than what consumers are accustomed to when drinking from cups, either disposable without the lid or permanent cups, or mugs. This rim width and curvature influences the mouth to conform to an unnatural shape compared to drinking from a lidless container. Although the one brand of prior art lid with the larger rectangular drinking hole has a thin rim were the user's lips touch the lid during drinking, the generally flat or very slightly curved tops of all prior art lids cause significant ergonomical disadvantages compared with the lid of this invention. That disadvantage of all lids of the prior art is compounded because most, if not all, upper surfaces of the prior art lids tend to contact the tip of the user's nose almost immediately upon tipping the cup for drinking. This untimely contact between nose and lid impedes comfortable sealing of the human lips around the drinking hole and simultaneously forces the head back to allow pouring of the beverage beyond approximately one-third consumption of the cup contents. Obviously, normal cups without lids do not require such exaggerated head tilting because the nose can pass through the top plane of the cup or mug opening in the absence of a cup lid thereby not forcing the nose to deform the normal drinking mode shape of the lips, and allowing the cup to tip virtually horizontal with little or no tilting of the head.

Taste and to some degree touch are the only senses that existing coffee lids allow the consumer to experience and enjoy. Users use touch to sense the temperature of the contents by manually feeling the temperature through the cup walls, and by contact between the lips and the plastic surface of the lid. Taste, by itself, without the compounded effect of multiple sensory responses, lowers the single sense effect. The limited touch sensing of the hot beverage temperature misrepresents the true temperature of the hot beverage until it pours out through the lid onto the tongue. The insulating effect of the plastic wall of the lid, and the shape and orientation of the spout in the lids of the prior art, deprives the consumer of optimal taste and touch perception.

Prior art lids allow pouring of the hot beverage deep into the mouth and onto the tongue too quickly. That deprives the drinker of timely anticipation of taste and temperature by the maximum number of taste buds and nerve endings located from the very front to the back of the mouth. When multiple senses are simultaneously stimulated, the sensory response of each sense is greater than the sense being stimulated alone. When physical interruptions and obstructions to a normal sensory experience exist, so do distractions from the normal experience and enjoyment of it. Its seems wasteful to drink a cup of $18.00 per gallon coffee, carefully selected, roasted, brewed, rich, hot and aromatic, through an inefficient lid which makes the experience less than full, clumsy and sometimes unpleasant.

Prior art lids for regular hot coffee or hot tea consumption are opaque and, except for the spout and a very tiny air vent hole, are vapor and liquid-sealed. The old saying, "I wish coffee tasted as good as it smells," begs the question: why should such a simple plastic lid deprive the consumer of using all available senses; smell, sight and touch to enhance the enjoyment of a good cup of coffee? The present invention provides a vehicle to enhance the coffee-drinking experience by involving multiple available senses in a comfortable and ergonomic manner.

There are other problems with prior art lids that are unrelated to the sensory issues. Removal of the lid to add and stir in condiments, while solving one problem, causes another in that the coffee cup walls become weaker and tend to flatten in the grasp of a hand. A cup without a lid allows the contents—in this case, hot coffee—to cool faster, which is undesirable. A cup without a lid is potentially-unsafe in the pedestrian and vehicular travel modes. The desire to not replace the lid usually overrides the physical practicality and safety aspects of replacing the lid unless the consumer is traveling while drinking in which case sensory response is sacrificed for safe and effective containment of the beverage.

The opaqueness of all prior art lids also deprives the consumer of seeing the color, motion and level of the coffee in the cup. Sight in and of itself does not stimulate a pleasure response because while drinking, one cannot see the coffee even when drinking from an open cup. To see the coffee just prior to drinking has a positive effect because the drinker sees the movement and color of the coffee in the cup. This effect causes the consumer to anticipate the taste, smell and temperature of the coffee, and to not be distracted by the uncertainty of when and at what flow rate the coffee will reach the spout. The elimination of these sensory obstacles with the addition of elements that facilitate sensory perception allows the consumer enhanced enjoyment of a gourmet cup of coffee.

SUMMARY OF THE INVENTION

It is an object of the invention disclosed and claimed herein to provide a beverage cup lid comprising a combination of structural and functional elements which enhance the sensory responses of taste, smell, touch and sight during drinking with the beverage cup lid in place. The sensory elements comprise openings, transparent materials, shape and media through which liquid and vapor can pass, and through which heat can conduct or convect. The media comprise: perforations, screens, membranes, fabrics, baffles or any systematic or random presence or arrangement of materials or lack thereof that passively blocks, impedes or controls the flow of liquid or vapor.

It is another object of this invention to provide a beverage cup lid comprising an access means to allow the addition and mixing of condiments while the lid is fully installed on the cup. The access means further comprises an opaque or transparent section of the lid with a flap or array of flaps, the flap or flaps being hinged, by impressing or stamping the lid material, allowing the access means to open by manipulation with an admixture dispensing implement or a stirring implement causing physical access to the contents for the addition and stirring of dairy products, dairy product substitutes, other additives and/or condiments. Then upon completion and removal of the admixture dispensing implement or stirring implement, the access means plastically recovers to its closed position.

It is another object of this invention to provide a beverage cup lid of entirely, predominantly, or substantially transparent material for the purpose of seeing the level, color and movement of the beverage for safe drinking in its hot temperature state, and for accurate adding and mixing of additives and condiments while the lid is fully installed on the cup.

It is another object of this invention to provide a beverage cup lid that ergonomically interacts with the user's mouth and that is ergonomically shaped to allow the user's nose to pass through the uppermost plane of the lid when the lidded cup is tilted while drinking. The invention therefore prevents undesirable physical contact between the lid material and the user's nose during tilting rotation of the lidded cup. The configuration of lid of the present invention optimizes sealing of the user's lips with the spout and dispenses with the user's need to tilt his or her head backwards in order to consume the cup's contents.

The invention disclosed herein integrates an easy-to-manufacture, user friendly, safe and ergonomically effective combination of elements of a press and lock on beverage cup lid: a spout, of a shape and location on the lid, to create an ergonomically effective interaction between the user's lips and the spout for optimal control of the discharging liquid; a taste and temperature sensing enhancing means allowing combined forces of capillary action and surface tension of liquid through and at, respectively, an area of the lid opposite the spout where the lid comes into contact with the upper surface of the front of the tongue that causes a greater force of surface tension to draw liquid through this area of the lid; olfactory enhancing means allowing passage of vapors through an area of the lid in the proximity of where the nostrils would be during drinking; a rim, of a shape, height and curvature that replicates the rim of a normal cup or mug, surrounding a transparent section of the lid acting as a window for visual access to the cup's contents; the entire lid being completely, predominantly or substantially made of transparent and or opaque material to facilitate any practicable, safe and logical degree of visual access to the cup's contents; and an access means comprising a flap or array of flaps that is or are hinged moveable portion(s) of the lid for physical access to the cup's contents to facilitate adding and stirring of dairy products, dairy product substitutes, sweeteners, other additives and condiments to the cup's contents.

DETAILED DESCRIPTION OF THE DRAWINGS

Spout (1) is an opening on the inside slope of the lid material just below the uppermost ridge of the lid. The General Lid Curvature (2) changes at Reverse Curvatures (3) to shape Mouth-Form (4). Taste and Temperature Sensing Means (5) is an array of very small perforations in the lid material very near the crest of the outside slope of the lid material. Olfactory Enhancing Means (6) is a radial array of very small perforations beginning outside the circumference of Hinge (7) and then radiating outward along radii from the lid's center, the perforations being positioned and in a logical pattern for the optimal passing of beverage vapors up through the lid and into the human nose. Array of Flaps (8) is formed by slits in the lid material, radiating outward from the lid center to the circumferential Hinge (7). The Flaps are each generally triangular and will bend downward when a stirrer stick or other similar implement is inserted into or through the lid. The Flaps' plasticity causes them to spontaneously reform when the stirrer stick or other implement is removed. Hinge (7) is a semicircular cross-section ring around the outer most limits of the Flap Slits (9). Access Point (10) is a point or small hole at the center of the lid material where stirrer sticks and other similar implements enter the beverage container made by the lid with a cup. Concave Surface (11) creates a bowl shaped hollow into the surface of the lid causing it to be deep enough such that when the human mouth joins with Mouth-Form (4) and the beverage container is fully rotated to the degree of completely emptying the container of beverage into the human mouth; the human nose never or rarely makes contact with the lid. Cup Engaging Rim (12) is a circumferential curvature, rectilinear cross-section or other such cross-sectional shape and skirt for engaging the lid with a variety of cups. Window (13) is transparent material of which the entire lid is made of or any logical, safe and practicable portion and shape to allow visual access to the container contents.

Figure 2:
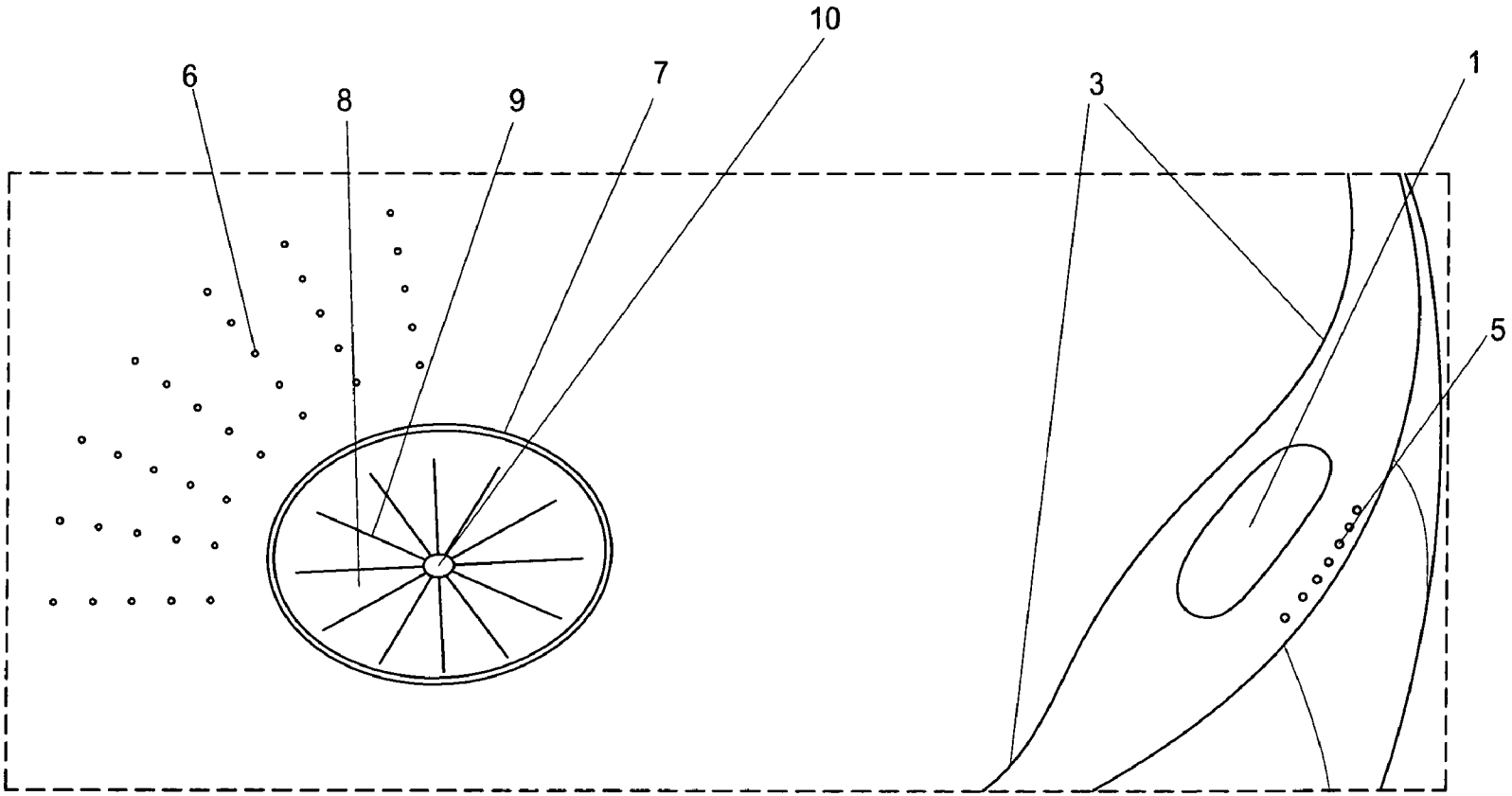
FIG. 2 is a detail blow-up of the lid's physical elements.

FIG. 2. is a blow-up detail of the Spout (1), Reverse Curvatures (3), Temperature and Taste Sensing Means (5), Olfactory Enhancing Means (6), Array of Flaps (8), Flap Slits (9), Access Point (10), and Hinge (7). Window (13) is transparent material of which the entire lid is made of or any logical, safe and practicable portion and shape to allow visual access to the container contents.

Figure 3:
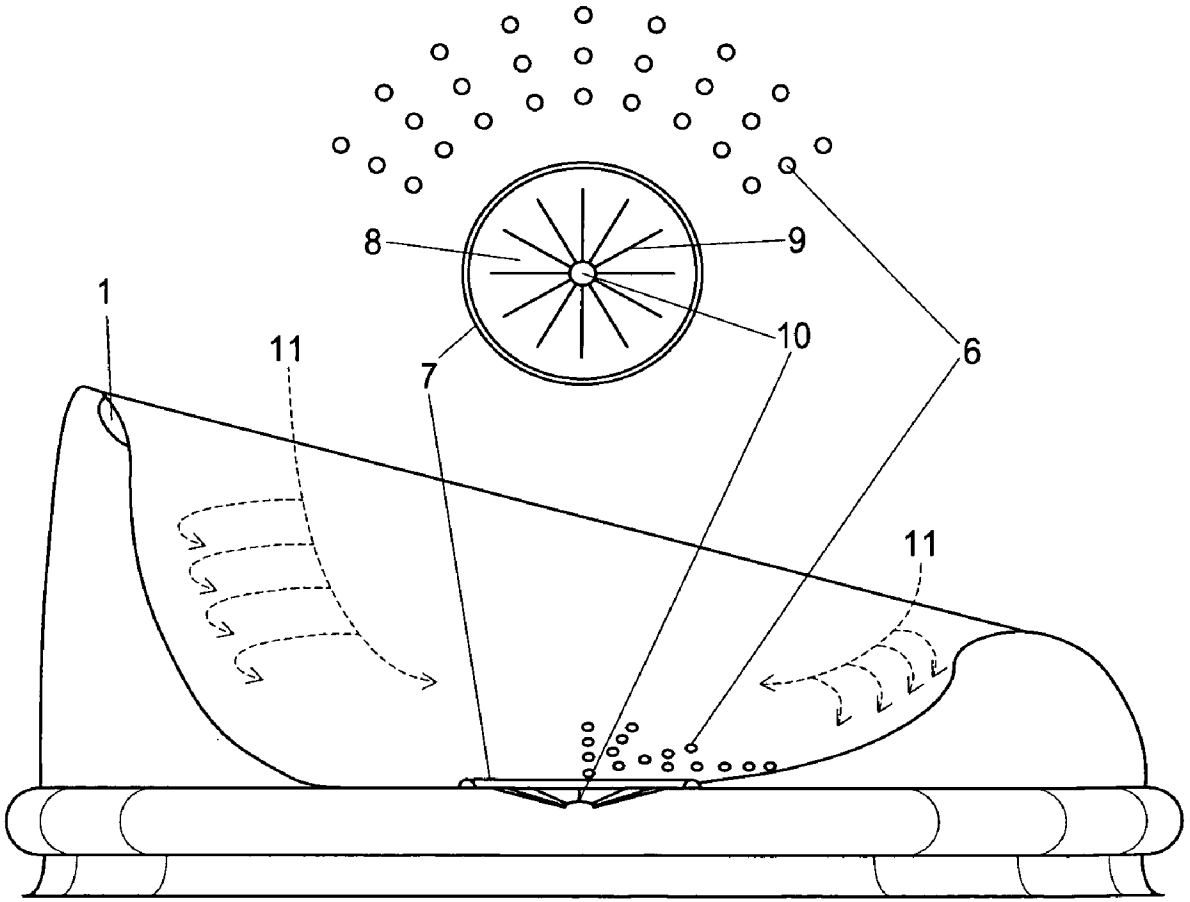
FIG. 3 is a cross-sectional side view of the profile of the invention.

FIG. 3 illustrates the height differential between the drinking side and the venting side of the top wall, which causes the plane of the top wall to be tilted or angled with respect to the horizontal mounting portion (12) which engages the lip of a cup. The top wall forms the rim of the bowl-shaped hollow (11) in the lid. As a result of the tilted top wall, the center point of the hollow is off-center from the center point of the mounting portion.

DESCRIPTION OF THE PREFERRED EMBODIMENT OF THE INVENTION

Figure 1:
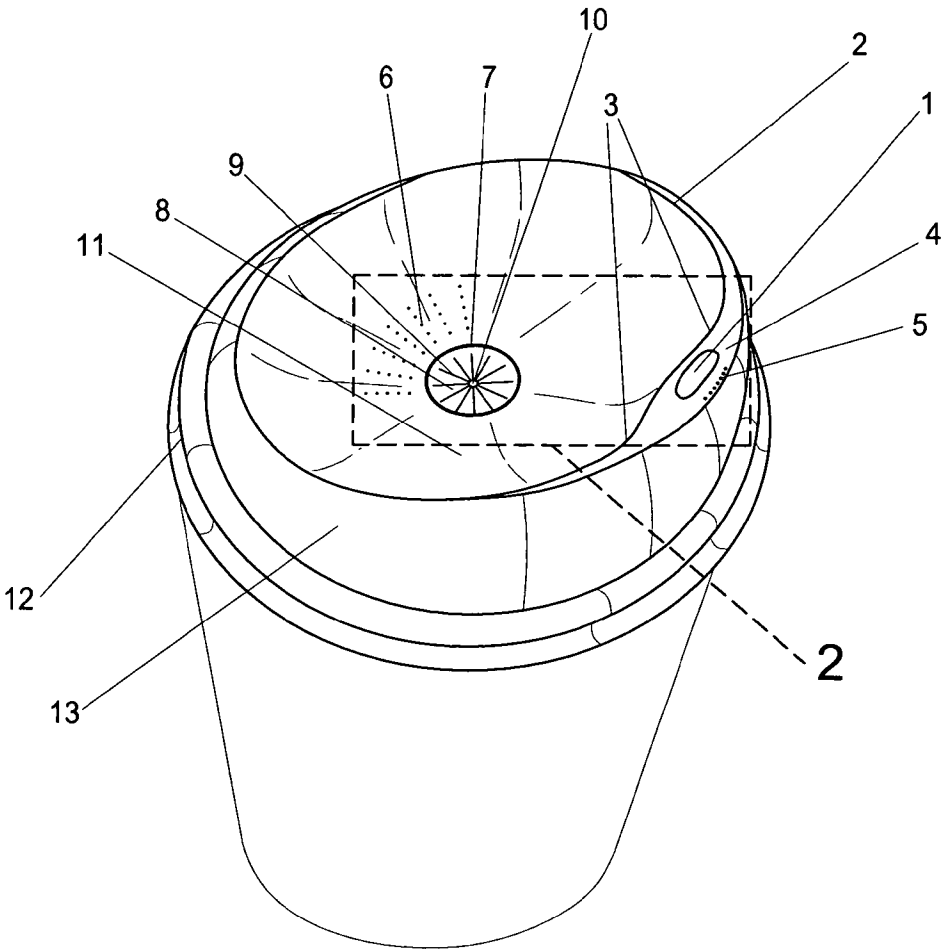
FIG. 1 is a top oblique perspective view of the lid of the present invention installed on a cup.

The preferred embodiment of the invention comprises physical elements that allow and enhance a person's multiple sensory drinking experience, facilitate a person's manipulation of the combined parts of the arrangement and create ergonomic shapes, spaces and features for optimal engaging, interfacing and mating of the parts of the human face with their respective parts of the invention disclosed herein, while drinking a beverage from a disposable or reusable beverage cup and lid, equivalent to drinking from a cup without a lid. Sensory enhancing, ergonomic and manipulation facilitating elements can be of numerous and varied means shapes and combinations that by the senses of taste, smell, touch and sight; and the implementation of ergonomics, can enhance the human experience, safety, manipulation and function of the invention. The physical elements of the invention comprise shapes, materials or the lack thereof, or combinations of both, transparent materials, and orientation of the elements that allow enhancement of human sensory response and optimal manipulation and ergonomics of the invention. Examples of multiple sensory shapes, and materials or the lack thereof, are depicted in FIGS. 1, 2 and 3 in the form of a thin shell molded, extruded or otherwise fabricated to an ergonomic shape. Material is oriented to optimize the fit between the invention and the human lips, tongue and nose, and to minimize the movement of the human head in performing the simple act of drinking. The lack of material allows optimal flow of a beverage into the mouth and onto the tongue and allows beverage vapors to escape the container, thereby allowing the sensory experience of smell. However, these materials or lack thereof can be of any logical form and combination of shape, orientation, absence, presence or type of material. For example, instead of perforations as depicted in two places on the invention, a membrane, fabric, screen or different shape of material penetrations can be oriented as depicted or logically located on any other part of the invention. How transparent-material facilitates manipulation of the invention must be imagined by considering that all figures depicted are of lids to be made entirely of transparent material that can not be depicted as transparent and therefore as invisible. The transparent material functions as a clear window to the beverage contents. Manual insertion of a stirrer stick and other relevant implements through the access means of the lid opens it which then, by the effect of material plasticity, automatically recovers to its closed position after manual stirrer stick and other relevant implements are removed. However, the transparent material can be of any logical shape, proportion or location on the invention to enhance visibility of the beverage contents and practicable manufacture. Physical access to the container contents can be through any logical moveable and recoverable shape, form and type of material. An example of an alternative to the depicted means is a two or three-dimensional aperture in the shape of a circle or cone, respectively, that opens outward and downward with the stirrer stick to form a funnel through which condiments can be added and stirred without removal of the lid from the cup. The effect of material plasticity causes the funnel shape to automatically recover to its closed position by removal of the stirrer stick. The entire circular transparent window can be a shallow inverted cone shape with the conical aperture of a smaller radius that opens and closes with the insertion and removal, respectively, of a stirrer stick.

Spout: the spout is an opening cut, molded or formed into the lid material to allow an optimal beverage discharge flow rate for drinking, equivalent to that of a cup without a lid. The shape, size and orientation of the spout allows: early contact between the forward surface of the upper lip and the beverage before it discharges into the mouth; pouring of the cup's contents into the mouth; and in the event of erratic movement of the cup's contents thereby causing splashing of beverage out through the spout, the ejected beverage will generally flow inward towards the center of the lid and back into the cup through openings that serve as other means and elements of the lid. The spout is on a plane that is at an angle less than minus 45 degrees, i.e., below horizontal, to facilitate thinning of the upper most rim of the lid and to cause the plane of the spout to approach horizontal—the permanent state of the beverage surface—as the cup and lid are rotated for drinking. The inner curvature of the lid symmetrically reverse curves in the proximity of the spout to create an ergonomic shape along the inner side of the spout to optimally fit with the curvature of the user's upper lip thereby allowing greater drinking comfort, cleaner and safer sealing of the lid by the lips and a shape that allows blind location of the spout by touch. The combination of the inner and outer contours of the rim of the lid in the proximity of the spout forms a shape that simulates the shape of the human lips when the mouth is opened to the degree for normal drinking from a cup without a lid.

Taste and Temperature Sensing Means: located just below the apex of the lid and behind the spout where the user would have a natural tendency to lead with the tongue, and which facilitates controlled passage of a liquid. The taste and temperature sensing means comprises a single linear array of tiny perforations, or could comprise any logical number of parallel linear arrays or array shapes for optimal contact with the upper surface of the front of the tongue. This element's physical properties, in relation to the surface tension of the contained beverage, blocks or impedes flow or seepage of the beverage until contact between it and the tongue as the cup and lid are tilted backward. The contact of the element with the tongue causes capillary action and surface tension on the liquid that then passes in minute amounts through the taste and temperature sensing enhancing means. That logically results in controlled passing of the beverage on to the taste buds, and temperature sensing nerve endings on the upper surface of the front of the tongue.

Olfactory Enhancing Means: located forward of center of the lowest surface of the lid and comprising a curved band of perforations in a radially aligned array. The olfactory enhancing means can comprise various other disclosed and claimed shapes, media, location or sizes that effectively allow the passage of vapor. The Olfactory enhancing means are generally located under or in the proximity of the position of the user's nostrils when he or she is drinking coffee using the lid of this invention. The physical properties of the olfactory enhancing means in relation to the surface tension and evaporation of the contained beverage allow beverage vapors to pass through it without compromising the integrity of the lid/cup combination or allowing the beverage to leak or spill.

Window: the entire lid or an inner circular area of the lid is transparent allowing visibility to the contents of the cup. In the event that for reasons of human health and safety, fabrication practicability and environmental concern, or any other preclusive and logical reason, the lid material can be opaque or translucent either in part or in its entirety.

Access means: an array of flaps or a single flap formed by impressing, stamping and cutting the lid material at the lowest central location of the lid surface allowing opening and closing of a relatively small portion of the lid surface. That structure allows the user to access the beverage to add and mix dairy products, dairy product substitutes, condiments and other additives with the beverage without removing the lid from the cup. Each flap's movement is facilitated by a hinge, array of hinges or hinge continuum along, near or nearly aligned with the fixed part of the hinge. The hinge is formed in the lid material by impressing, affixing or molding the lid material, the cross-section of the hinge being semicircular, circular, rectilinear, curved, triangular or any other functional cross-section. Each flap shape can be a triangle, semicircle, rectangle, square or any other functional shape. The opening of each flap or array of flaps is actuated by the insertion of a stirrer stick or any other implement or device used for the purpose of adding and mixing into the beverage: dairy products, dairy product substitutes, sweeteners, condiments or any other additives. Upon removal of the stirring, mixing or adding implement from the opened flap or flaps, the plasticity of the lid material causes the flap(s) to spontaneously re-form itself to a closed position.

Concave Surface The inner surface of the lid can be concave, bowl-shaped or can be of any functional inverted shape, and capable of providing space for the human nose. That characteristic minimizes or prevents altogether any contact between the lid and the user's nose while drinking. That feature results in the user not having to severely tilt his or her head backward in order to complete drinking of the beverage. That element of the invention allows the human head to remain virtually erect during drinking through the lid, allows the drinker's eyes to continuously focus forward on the normal field of view while walking or driving and prevents the lid and cup from rising into and blocking the drinker's field of view.

What is claimed is:

1. A lid for a drinking cup comprising:

a. a rounded top wall having a generally circular periphery;

b. an annular outward side wall depending from said rounded top wall outwardly about its periphery, the outward side wall comprising a drinking side, a venting side, a top and a bottom, the drinking side and the venting side being approximately 180 degrees apart, the drinking side being taller than the venting side, resulting in a height differential of the rounded top wall between the drinking side and the venting side;

c. an annular mounting portion at the bottom of the annular outward side wall for sealingly engaging a lip of the drinking cup, the annular mounting portion being horizontal with respect to the lip of the drinking cup and the rounded top wall being tilted with respect to the annular mounting portion by virtue of the height differential of the rounded top wall;

d. an annular inward side wall depending from the rounded top wall inwardly about its periphery;

e. a bowl-shaped hollow formed by the closure of the annular inward side wall about all the side wall's sides, the rounded tip wall forming a top rim of the hollow, the hollow being tilted with respect to the annular mounting portion by virtue of the top wall's height differential; the hollow being capable of ergonomically accommodating a user's nose while drinking without the user's nose touching the lid, the hollow comprising an access means, the access means comprising an annular hinge around its center, the hinge comprising an array of flaps resulting from cutting or stamping the annular hinge, the flaps being closed together and slightly slanted downwardly to a hold in the hollow at a location equivalent to the center of the annular mounting portion, the hold equal to or less than a cross-sectional dimension of a shaft of a common beverage stirring device, the access means allowing back drainage of any portion of a cup's contents that could otherwise accumulate in the hollow, the access means being capable of opening inwardly along flaps' hinges upon external pressure allowing the introduction of a beverage stirring device, additional liquid or condiments into the cup without removal of the lid, in such a way that upon removal fo the external pressure, the flaps plastically recover to their closed position;

f. a drinking opening spout located at a highest point of the annular inward side wall extending downwardly and inwardly along the annular inward shell forming a mouthpiece to enable drinking from the cup without removal of the lid, the spout sized to allow a beverage to discharge at a flow rate equivalent to that of a drinking cup without a lid, the spout's position, shape and size being such that a lid's user's upper lip seals over the spout thus preventing liquid spillage, the spout's shape comprising symmetrically reverse curves to accommodate a shape of a user's pursed lips;

g. a linear medium area located on the rounded top wall directly across from the spout, the linear medium area being permeable so as to facilitate the controlled passage of a discharging liquid; and h. an olfactory enhancing means located along the lower most area of the hollow to enable olfactory perception of the liquid in the cup without removal of the lid.

2. A lid for a drinking cup according to claim 1, wherein the lid is completely or partially made out of transparent material so that the user can see the appearance, motion and level of the beverage in the cup.

3. A lid for a drinking cup according to claim 1, wherein the hinge and array of flaps and an extended area around the hinge is made out of transparent material so that the user can see the appearance, motion and level of the beverage, in the cup, through a partially transparent area of the lid.

4. A lid for a drinking cup according to claim 1, wherein the access means is achieved by impressing or stamping the hinge and flaps into the lid material or into separate material and then affixing the hinge and flaps to the lid.

5. A lid for a drinking cup according to claim 1, wherein the olfactory enhancing means comprises an arc or other logically shaped system selected from the group consisting of a plurality of small perforations, a permeable membrane, a permeable screen, a permeable piece of fabric, and a plurality of fine slits.

6. A lid for a drinking cup according to claim 1, wherein the linear medium area comprises a system selected from the group consisting of a permeable membrane, a permeable fabric, a permeable screen, a plurality of fine baffles, a plurality of fine circular perforations and a plurality of fine slits.

* * * * *